US008845055B2

(12) United States Patent
Munakata

(10) Patent No.: US 8,845,055 B2
(45) Date of Patent: Sep. 30, 2014

(54) CONTROL APPARATUS FOR A LIQUID EJECTING HEAD, LIQUID EJECTING APPARATUS, AND CONTROL METHOD FOR A LIQUID EJECTING HEAD

(75) Inventor: Manabu Munakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 307 days.

(21) Appl. No.: 13/283,539

(22) Filed: Oct. 27, 2011

(65) Prior Publication Data

US 2012/0105530 A1 May 3, 2012

(30) Foreign Application Priority Data

Oct. 29, 2010 (JP) ..... 2010-243289

(51) Int. Cl.
*B41J 29/38* (2006.01)
*B41J 2/175* (2006.01)

(52) U.S. Cl.
CPC ..... *B41J 2/17566* (2013.01); *B41J 29/38* (2013.01)
USPC ..... 347/14; 347/7; 347/40

(58) Field of Classification Search
USPC ..... 347/7, 85, 14, 40
See application file for complete search history.

(56) References Cited

U.S. PATENT DOCUMENTS

| | | | | |
|---|---|---|---|---|
| 6,497,469 | B1 * | 12/2002 | Shinada et al. | 347/19 |
| 2006/0164458 | A1 | 7/2006 | Saikawa | |
| 2010/0295883 | A1 | 11/2010 | Saikawa | |

FOREIGN PATENT DOCUMENTS

| | | | | |
|---|---|---|---|---|
| JP | 11-334104 | * | 12/1999 | 347/7 |
| JP | 2003-001842 | A | 1/2003 | |
| JP | 2006-205367 | A | 8/2006 | |

* cited by examiner

*Primary Examiner* — Julian Huffman
(74) *Attorney, Agent, or Firm* — Kilpatrick Townsend & Stockton LLP

(57) ABSTRACT

A threshold passed signal indicating that a threshold for a remaining liquid amount has been passed is inputted from a threshold sensor that detects the actual remaining liquid amount in the liquid holding unit when the liquid ejection command is being executed, the control apparatus drives the liquid ejecting head so that the liquid continues to be ejected based on the liquid ejection command until the inputted liquid ejection command ends.

10 Claims, 7 Drawing Sheets

CONTROL APPARATUS FOR A LIQUID EJECTING HEAD, LIQUID EJECTING APPARATUS, AND CONTROL METHOD FOR A LIQUID EJECTING HEAD

The entire disclosure of Japanese Patent Application No: 2010-243289, filed Oct. 29, 2010 is expressly incorporated by reference herein.

BACKGROUND

1. Technical Field

The present invention relates to control apparatuses for liquid ejecting heads, liquid ejecting apparatuses, and control methods for liquid ejecting heads that eject a liquid through nozzles.

2. Related Art

In recent years, ink jet recording apparatuses such as ink jet printers, plotters, and the like, which print images and so on by ejecting ink droplets onto paper, are being widely used as liquid ejecting apparatuses that eject liquid droplets onto a target. In an ink jet recording apparatus, printing is carried out by moving a recording head in the main scanning direction while moving the paper in the sub scanning direction. Specifically, the recording head and an ink cartridge are mounted in a carriage, and the carriage is then moved in the main scanning direction. Nozzle rows, in which nozzles are arranged in rows, are formed in the bottom surface of this type of recording head, and the ink cartridge and the nozzles are connected to each other through a flow channel. In other words, ink flows from the ink cartridge, through the flow channel, and to the nozzle rows.

A printer that includes first and second ink cartridges holding the same color of ink, a first flow channel that connects the first ink cartridge with a first nozzle row, and a second flow channel that connects the second ink cartridge with a second nozzle row, is known as this type of ink jet recording apparatus (see JP-A-2003-1842). The nozzles in the first nozzle row and the nozzles in the second nozzle row are disposed in positions that are skewed relative to each other in the sub scanning direction (that is, the paper feed direction). Accordingly, it is possible to print two lines worth of dots simultaneously by ejecting ink from the first and second nozzle rows simultaneously. Furthermore, this printer includes a remaining ink estimation unit that detects the amount of ink remaining in the first and second ink cartridges, and a selection unit that selects the ink cartridge to use to form dots based on the remaining amount of ink.

However, with an ink jet printer that includes first and second ink cartridges holding the same color of ink, as is the case with the printer according to JP-A-2003-1842, if the ink in one of the ink cartridges is exhausted, printing may be suspended partway through the page that is currently being printed.

If the printing is suspended partway through the page in this manner, it is necessary to resend the print data to the printer after replacing the ink cartridge and then resume printing from the beginning of the page in which the printing was suspended; this is a problem not only in that time and effort are required, but also in that paper, ink, and so on are wasted.

Although continuing the printing from the location at which the printing was suspended using only the ink cartridge in which ink still remains can be considered, such a method is unrealistic because a difference in color between the areas printed after the printing is resumed and the areas printed before the suspension can arise, leading to a drop in the quality of the print.

It should be noted that this problem is not limited to ink jet printers that eject ink, and also appears in the same manner in liquid ejecting apparatuses that eject other liquids.

SUMMARY

It is an advantage of some aspects of the invention to provide a control apparatus for a liquid ejecting head, a liquid ejecting apparatus, and a control method for a liquid ejecting head that prevent the ink in an ink cartridge from being exhausted, and printing from being suspended, partway through a page.

A control apparatus for a liquid ejecting head according to an aspect of the invention is a control apparatus for a liquid ejecting head, the liquid ejecting head including nozzle rows in which nozzles that eject a liquid from two or more liquid holding units that hold the same liquid are arranged in rows and an ejection unit that causes the liquid to be ejected through the nozzles, and the control apparatus for the liquid ejecting head causing the liquid to be ejected through the nozzles by driving the liquid ejecting head based on a liquid ejection command when the liquid ejection command has been inputted; when a threshold passed signal indicating that a threshold for a remaining liquid amount has been passed is inputted from a threshold sensor that detects the actual remaining liquid amount in the liquid holding unit when the liquid ejection command is being executed, the control apparatus drives the liquid ejecting head so that the liquid continues to be ejected based on the liquid ejection command until the inputted liquid ejection command ends.

According to this aspect of the invention, by employing a configuration in which the threshold passed signal is inputted from the threshold sensor, an extra margin can be provided for the remaining ink amount, which makes it possible to form a configuration in which the ejection unit can be driven until the inputted liquid ejection command ends; as a result, the printing can be prevented from being suspended partway through the inputted liquid ejection command.

According to another aspect of the invention, in the case where the threshold passed signal has been inputted from all of the two or more liquid holding units after the ejection unit has been driven until the inputted liquid ejection command ends, it is preferable for the control apparatus to make a notification prompting all of the two or more liquid holding units to be replaced; and in the case where the threshold passed signal has been inputted from one of the two or more liquid holding units, when the next liquid ejection command is executed, it is preferable for the control apparatus to drive the ejection unit so that the ejection amount of the nozzle row to which the liquid is supplied from the liquid holding unit whose threshold sensor outputted the threshold passed signal becomes less than the ejection amounts of the other nozzle rows.

According to another aspect of the invention, it is preferable for the control apparatus to further include a remaining liquid amount estimation unit that estimates a remaining liquid amount that is the remaining amount of liquid held in each of the liquid holding units. Here, it is preferable, in the case where the threshold passed signal has been inputted from at least one of the two or more liquid holding units after the ejection unit has been driven until the inputted liquid ejection command ends, for the control apparatus to determine whether or not the difference between the remaining liquid amounts estimated by the remaining liquid amount estimation unit from the remaining liquid amount estimation unit is greater than a predetermined value; in the case where the difference between the remaining liquid amounts estimated by the remaining liquid amount estimation unit from the remaining liquid amount estimation unit is greater than the predetermined value, when the next liquid ejection command is executed, for the control apparatus to carry out control so that the liquid is ejected only from the nozzle rows to which the liquid is supplied from the liquid holding unit that has the greater remaining amount of liquid; and in the case where the difference between the remaining liquid amounts estimated by the remaining liquid amount estimation unit from the remaining liquid amount estimation unit is less than the predetermined value, when the next liquid ejection command is executed, for the control apparatus to carry out control so that the liquid ejection amount of the nozzle rows to which the liquid is supplied from the liquid holding unit having a higher remaining amount is greater than the liquid ejection amount of the nozzle rows to which the liquid is supplied from the liquid holding unit having a lower remaining amount. By carrying out control in this manner, it is possible to replace liquid holding units that hold the same liquid at the same time.

According to another aspect of the invention, it is preferable for the control apparatus to carry out a notification prompting the liquid holding unit, of the two or more liquid holding units, that is provided with the threshold sensor from which the threshold passed signal has been inputted to be replaced after the ejection unit has been driven until the inputted liquid ejection command ends.

According to another aspect of the invention, it is preferable for the nozzle rows to be configured of first and second nozzle rows whose respective nozzles are in the same position in a nozzle row direction and third and fourth nozzle rows whose nozzle positions are skewed from each other in the nozzle row direction, and for the first nozzle row and the third nozzle row to be connected to a first liquid holding unit, and the second nozzle row and the fourth nozzle row to be connected to a second liquid holding unit.

A liquid ejecting apparatus according to another aspect of the invention includes: a liquid ejecting head including nozzle rows in which nozzles that eject a liquid from two or more liquid holding units that hold the same liquid are arranged in rows and an ejection unit that causes the liquid to be ejected through the nozzles; a control unit that causes the liquid to be ejected through the nozzles by driving the liquid ejecting head based on a liquid ejection command when the liquid ejection command has been inputted; and threshold sensors that detect the actual remaining liquid amount in respective liquid holding units and input threshold passed signals indicating that the remaining liquid amounts have exceeded a threshold to the control unit. When the threshold passed signal is inputted from the threshold sensor during the execution of the liquid ejection command, the control unit drives the liquid ejecting head so as to continue ejecting the liquid based on the inputted liquid ejection command until the liquid ejection command ends.

A liquid ejecting apparatus according to another aspect of the invention includes: a liquid ejecting head including nozzle rows in which nozzles that eject a liquid from two or more liquid holding units that hold the same liquid are arranged in rows and an ejection unit that causes the liquid to be ejected through the nozzles; and a control unit that causes the liquid to be ejected through the nozzles by driving the liquid ejecting head based on a liquid ejection command when the liquid ejection command has been inputted. When a threshold passed signal indicating that a threshold for a remaining liquid amount has been passed is inputted from a threshold sensor that detects the actual remaining liquid amount in the liquid holding unit when the liquid ejection command is being executed, the control apparatus drives the liquid ejecting head so that the liquid continues to be ejected based on the liquid ejection command until the inputted liquid ejection command ends.

A control method for a liquid ejecting head according to another aspect of the invention is a control method for a liquid ejecting head including nozzle rows in which nozzles that eject a liquid from two or more liquid holding units that hold the same liquid are arranged in rows and an ejection unit that causes the liquid to be ejected through the nozzles, the control method causing the liquid to be ejected through the nozzles by driving the liquid ejecting head based on a liquid ejection command when the liquid ejection command has been inputted; when a threshold sensor that inputs a threshold passed signal in the case where the threshold sensor has detected that the remaining amount of liquid held in a corresponding liquid holding unit has exceeded a threshold has inputted the threshold passed signal during the execution of the liquid ejection command, the liquid ejecting head is driven so that the liquid continues to be ejected based on the liquid ejection command until the inputted liquid ejection command ends.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
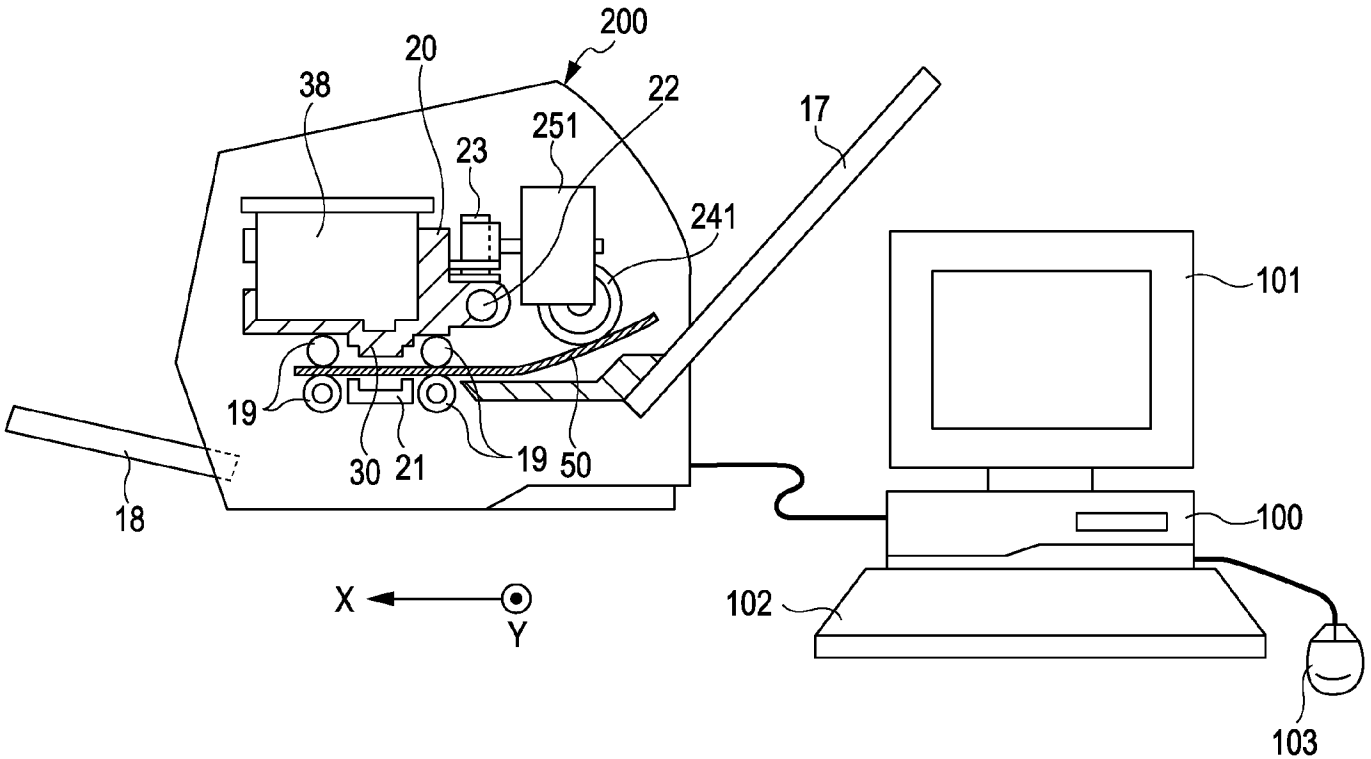
FIG. 1 is a conceptual diagram illustrating the overall configuration of a printing system according to a first embodiment of the invention.

A first embodiment of the invention will be described with reference to FIGS. 1 through 5. As shown in FIG. 1, a liquid ejecting system that employs the liquid ejecting apparatus according to the invention includes a computer 100 that is used by a user, and an ink jet printer (called simply a "printer" hereinafter) 200 that is connected to the computer 100 and that serves as the liquid ejecting apparatus. The computer 100 is provided with a keyboard 102 and a mouse 103, and text is inputted, settings are changed, and so on by manipulating the keyboard 102 and the mouse 103. In addition, the computer 100 is connected to a monitor 101. Using this monitor 101, the user can specify document images he or she wishes to print, instruct printing to be executed, and so on.

Meanwhile, the printer 200 includes, on its outside, a paper supply tray 17 and a paper discharge tray 18, and includes, on its inside, a plurality of paper feed rollers 19. The paper feed rollers 19 are driven as appropriate by a paper feed motor 241. When the paper feed rollers 19 are rotationally driven by the paper feed motor 241 in this manner, the printer 200 introduces a medium 50, which serves as a target, from the paper supply tray 17, transports this medium 50 in a sub scanning direction X, and discharges the medium 50 to the paper discharge tray 18. Standard paper is a typical example of the medium 50, but the medium 50 may be any medium onto which printing can be carried out; for example, glossy special paper, non-glossy special paper, clothing fabrics, matte paper, polyvinyl chloride, or the like may be used as well.

The printer 200 also includes, on its inside, a carriage 20 and a platen 21 opposed thereto. The platen 21 is a support platform that supports the medium 50 during printing, and during printing, the medium 50 is transported above this platen 21 by the paper feed rollers 19. The carriage 20 is fitted onto a guide shaft 22, and is affixed to a timing belt 23. The timing belt 23 is driven by a carriage motor 251. By driving this timing belt 23, the carriage 20 that is affixed to the timing belt 23 can be moved back and forth in a main scanning direction Y (the direction orthogonal to the paper surface, in FIG. 1).

The carriage 20 includes, on its bottom surface, a recording head 30 that serves as a liquid ejecting head. Ink is supplied to the recording head 30 from ink cartridges, which will be described in detail later, and the recording head 30 ejects the supplied ink. In other words, with the printer 200 according to this embodiment, printing is carried out onto the medium 50, which moves in the sub scanning direction X, by ejecting various colors of ink from the recording head 30 while the carriage 20 is moved back and forth in the main scanning direction Y.

Figure 2:
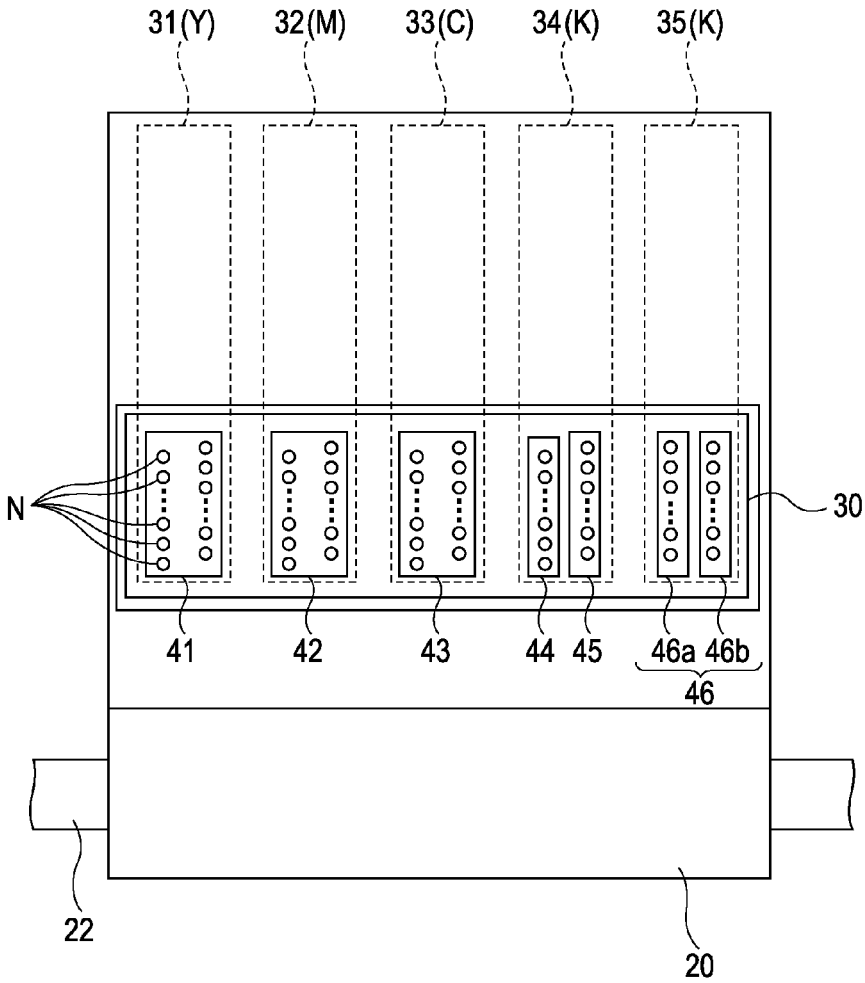
FIG. 2 is a bottom view of a recording head.

The recording head will be described hereinafter with reference to FIG. 2. The carriage 20 includes, on its bottom surface, the recording head 30 that serves as a liquid ejecting head. As shown in FIG. 2, ejection portions 41, 42, 43, 44, and 45, as well as an ejection portion group 46, which are configured by forming nozzle rows configured of a plurality of nozzles N, are provided on the bottom surface of the recording head 30.

Meanwhile, five ink cartridges 31, 32, 33, 34, and 35, which all have the same shape, are mounted within the carriage 20. Each of the ink cartridges 31 through 35 is connected to two rows of nozzles N located therebelow via flow channels, which will be described in detail later. In other words, the ink from the ink cartridges 31 through 35 is ejected to the exterior from the nozzles in the ejection portions 41 through 45 and the ejection portion group 46 located below the respective ink cartridges 31 through 35 via the flow channels.

Yellow (Y) ink is held in the ink cartridge 31, magenta (M) ink is held in the ink cartridge 32, cyan (C) ink is held in the ink cartridge 33, and black (K) ink is held in the ink cartridges 34 and 35. In other words, one ink cartridge each for the colors of cyan, magenta, and yellow, and two ink cartridges for the color black, are mounted in the carriage 20. Note that when not in use, the black ink cartridges 34 and 35 hold the same amount of ink. In the following descriptions, the ink cartridge 34 will be referred to as a first ink cartridge 34, whereas the ink cartridge 35 will be referred to as a second ink cartridge 35.

Figure 3:
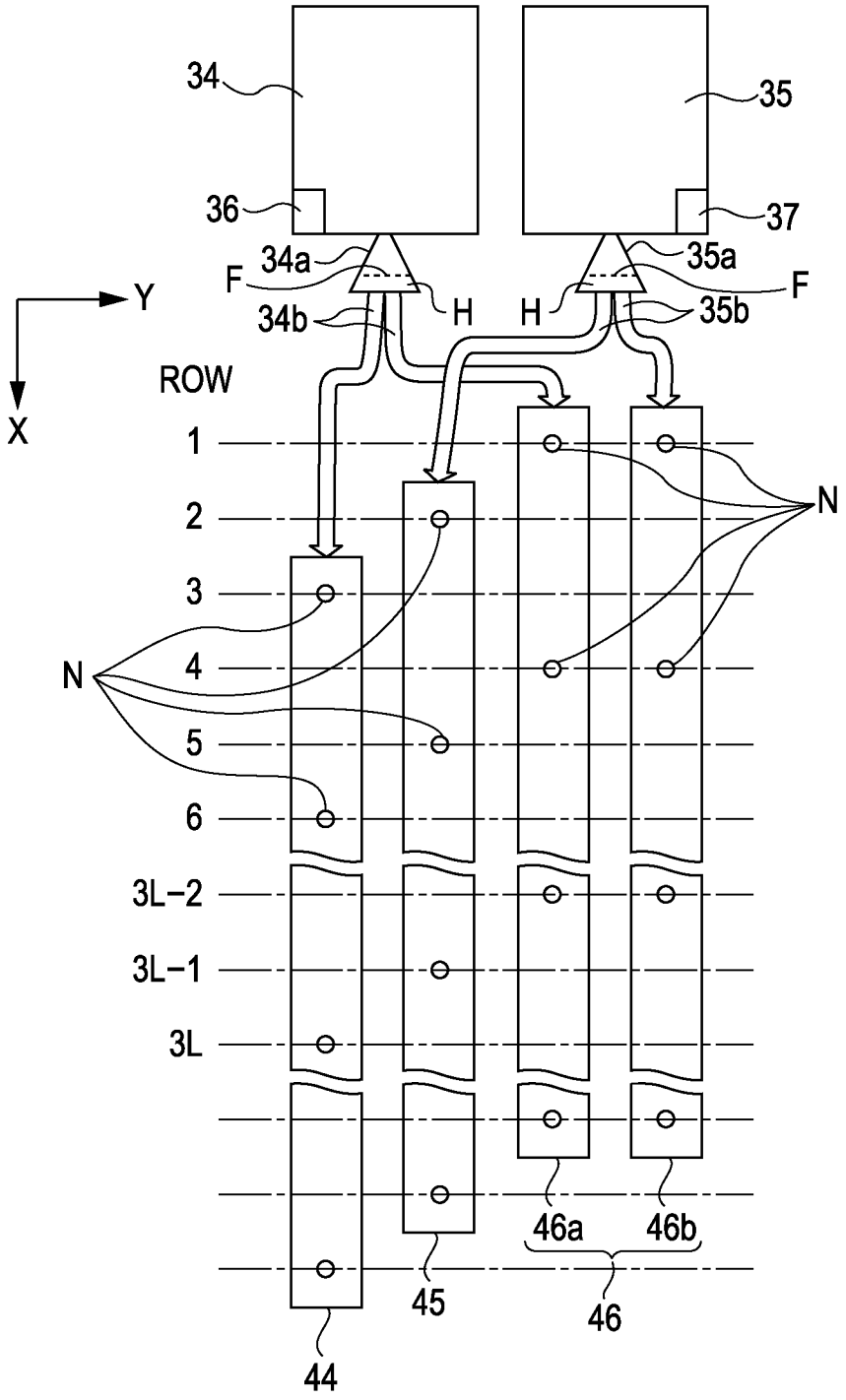
FIG. 3 is a descriptive diagram illustrating a relationship between ink cartridges, ejection portions, and individual ejection portions.

Next, FIG. 3 is a descriptive diagram illustrating a relationship between the black (K) first and second ink cartridges 34 and 35, the ejection portions, and individual ejection portions. As shown in FIG. 3, a first threshold sensor 36 is provided in the first ink cartridge 34. Likewise, a second threshold sensor 37 is provided in the second ink cartridge 35. The first and second threshold sensors 36 and 37 are, for example, liquid surface sensors; when the remaining ink amount in the ink cartridge in which the sensor is provided is greater than a set threshold (called a "near end amount" hereinafter), the sensor outputs an "off" signal, whereas when the amount of remaining ink drops below the near end amount, the sensor outputs an "on" signal indicating that the near end amount has been passed (a "threshold passed signal"), and these signals are inputted into a control unit (control apparatus) which will be described later. In other words, the first and second threshold sensors 36 and 37 do not continually obtain the remaining ink amount in a linear manner.

Here, the near end amount refers to a remaining ink amount in the ink cartridge that is greater by a predetermined amount than an ink end amount, which is the amount at which ink can no longer be ejected. This predetermined amount is set according to a relationship with print data, which serves as a liquid ejecting command. To be more specific, the print data is data that is generated by the CPU of a computer, mentioned later, and sent to the CPU of a printer in order to print a printing target specified by a user, and is data obtained by dividing the printing target specified by the user into pre-set units of single page or a plurality of pages. An ink amount that allows the entirety of a page in the print data to be filled with the same color corresponds to the predetermined amount, and the "page" mentioned here refers to the maximum size of the medium of the liquid ejecting apparatus.

For example, in the case where the printer 200 is capable of printing up to A4-size pages, and the print data is generated on a page-by-page basis and inputted into the printer, the "predetermined amount" is the amount of ink capable of filling a single A4-size recording sheet. Note that in the case where the printing target spans across a plurality of pages, the printing target is divided into a plurality of pieces of print data in units of a plurality of sheets. For example, in the case where the print data is generated for every two sheets, and the printing target is a document configured of 10 pages of A4-sheets, the print data is divided into five pieces of data, one piece for every two sheets. Of course, this print data is divided so as not to fall partway through a page of the target medium. In this embodiment, the print data is generated on a sheet-by-sheet basis, and the near end amount is set to an amount capable of filling a single A4-size sheet.

Note that if the near end amount is greater than the amount capable of filling the entirety of a page of the print data with a single color, an instruction to replace the ink cartridge will appear despite a large amount of ink remaining within the ink cartridge; this will result in the ink being discarded, and will increase the wasteful consumption of ink as a result. On the other hand, if the near end amount is less than the amount capable of filling the entirety of a page of the print data, the ink may be exhausted partway through a page and the printing may be suspended as a result. Accordingly, it is desirable to set the near end amount to an amount capable of filling the entirety of a page of the print data with a single color.

Part of the base surfaces of the first and second ink cartridges 34 and 35 is covered with a film. Meanwhile, a pin 34*a* and a pin 35*a* are provided in the carriage 20 (see FIG. 1). When the first ink cartridge 34 is mounted in the carriage 20, the pin 34*a* penetrates the film and enters into the interior of the first ink cartridge 34. Likewise, when the second ink cartridge 35 is mounted in the carriage 20, the pin 35*a* penetrates the film and enters into the interior of the second ink cartridge 35. Through-holes (not shown) that progress from the tips to the base portions are provided in the pins 34*a* and 35*a*. When the pins 34*a* and 35*a* enter into the first and second ink cartridges 34 and 35, the ink flows into the through-holes of the pins 34*a* and 35*a* from the first and second ink cartridges 34 and 35 and flows through those through-holes. Note that the other ink cartridges 31 through 33 are configured in the same manner. In other words, the ink cartridges 31 through 33 are also configured so that when pins (not shown) enter thereinto, the ink from the ink cartridges 31 through 33 flows through the through-holes in those pins. The through-holes of the pins 34*a* and 35*a* are provided with filters F that prevent foreign objects, bubbles, and so on from entering into the base portions of the pins 34*a* and 35*a*, and ink chambers H are located downstream from these filters F. Two branched first flow channels 34*b* are provided in the ink chamber H that is provided in the pin 34*a*. Likewise, two branched second flow channels 35*b* are provided in the ink chamber H that is provided in the pin 35*a*. Note that in the following descriptions, the ejection portion 44 is referred to as a "first ejection portion 44", whereas the ejection portion 45 is referred to as a "second ejection portion 45". Furthermore, an individual ejection portion 46*a* is referred to as a "first individual ejection portion 46*a*", whereas an individual ejection portion 46*b* is referred to as a "second individual ejection portion 46*b*".

A plurality of nozzles N are provided in the first ejection portion 44 and the second ejection portion 45, as well as in the ejection portion group 46. The positions in which the nozzles N are formed in the sub scanning direction X in the first ejection portion 44, the second ejection portion 45, and the ejection portion group 46, are skewed relative to each other. For example, the nozzle N of the nozzle row in the first ejection portion 44 is located in the 3Lth row (where L is a natural number), the nozzle N of the nozzle row in the second ejection portion 45 is located in the (3L−1)th row, and the nozzles N of the nozzle rows in the ejection portion group 46 are located in the (3L−2)th row. In this manner, the nozzles N in the first ejection portion 44, the second ejection portion 45, and the ejection portion group 46 are disposed in different positions in the sub scanning direction X. Meanwhile, the nozzles N in the first individual ejection portion 46*a* and the second individual ejection portion 46*b* of which the ejection portion group 46 is configured are formed in the same locations in the sub scanning direction X.

The first flow channels 34*b* connect the first ink cartridge 34, the first ejection portion 44 and the first individual ejection portion 46*a*. Meanwhile, the second flow channels 35*b* connect the second ink cartridge 35, the second ejection portion 45 and the second individual ejection portion 46*b*. In other words, in this embodiment, ink is supplied from the two first and second ink cartridges 34 and 35 to the three types of ejection portions, or the first ejection portion 44, the second ejection portion 45, and the ejection portion group 46, via the first and second flow channels 34*b* and 35*b*.

In addition, pressure chambers (not shown) are provided in the first ejection portion 44, the second ejection portion 45, and the ejection portion group 46, in correspondence with each of the plurality of nozzles N, and piezoelectric elements 261 (see FIG. 4) are disposed therein. The pressure in a pressure chamber changes when its corresponding piezoelectric element 261 expands or contracts, and as a result, ink droplets are ejected through the nozzles N onto the medium 50 (see FIG. 1).

In other words, in black-and-white printing and color printing, the black ink that fills the first and second ink cartridges 34 and 35 is ejected toward the medium 50 from the first ejection portion 44, the second ejection portion 45, and the ejection portion group 46 that communicate with the first and second ink cartridges 34 and 35.

Next, the electrical configuration of this printing system will be described with reference to FIG. 4. The computer 100 is connected to the keyboard 102, the mouse 103, and the monitor 101 via a bus line 160, and includes a CPU 110 that functions as a control center.

The CPU 110 is connected to a RAM 120 and a ROM 130 via the bus line 160. The RAM 120 functions as a work region for the CPU 110, and a boot program or the like is stored in the ROM 130. Furthermore, the CPU 110 is connected to a hard disk 140 via the bus line 160, and the CPU 110 can access the hard disk 140. Data and programs are recorded in the hard disk 140. Document data, graphic data, image data, or the like that are to be printed are examples of this data. A printer driver program and a printing application program that have been read from an information recording medium (not shown) and installed can be given as examples of such programs.

The printer driver program is a program that, when a printing target has been specified by the user, converts print data, which corresponds to a liquid ejection command created based on document data, image data, or the like, into intermediate image data that can be processed by the printer 200. For example, a multivalue signal for each of the colors of cyan, magenta, yellow, and black can be given as an example. Meanwhile, the printing application program is a program that causes the CPU 110 to carry out predetermined operations in order to obtain information, perform calculations, and so on as necessary for printing, in response to a user operation. In other words, in accordance with this printing application program, the CPU 110 generates print data for causing ink of a predetermined color to be ejected onto the medium 50 from the nozzles N.

Furthermore, the CPU 110 is connected to an interface unit 150 via the bus line 160. The CPU 110 communicates with the printer 200 via the interface unit 150.

Meanwhile, the printer 200 includes a control unit 201 that carries out the overall control of the printer 200. The control unit 201 includes a CPU 210 that functions as a control center, and the CPU 210 communicates with the computer 100 via an interface unit 270 to which the CPU 210 is connected via a bus line 290. The CPU 210 is connected to a RAM 220 and a ROM 230 via the bus line 290. The RAM 220 functions as a work region, and temporarily saves print data received from the computer 100. Predetermined programs are stored in the ROM 230, and the CPU 210 carries out predetermined operations and executes printing based on these programs.

In addition, the CPU 210 of the printer 200 is connected, via the bus line 290, to a feed motor driving unit 240, a movement motor driving unit 250, and a head driving unit 260. The feed motor driving unit 240 drives the paper feed motor 241, whereas the movement motor driving unit 250 drives the carriage motor 251. Meanwhile, the head driving unit 260 drives the piezoelectric elements 261 under the control of the CPU 210, in synchronization with the driving of the carriage motor 251 and a paper feed motor 241.

Incidentally, when print data is inputted into the control unit of the printer 200 and printing is carried out by ejecting ink from the first and second ejection portions 44 and 45 using the same color of ink from the first and second ink cartridges 34 and 35, there are cases where the ink in one of the first and second ink cartridges 34 and 35 is exhausted partway through a page.

In such a case, if the ink in one or both of the first and second ink cartridges 34 and 35 is exhausted, it is necessary to replace the ink cartridge partway through the page and carry out the printing once again from the beginning of the page at which the printing was suspended after the CPU 110 regenerates the print data; therefore, it is necessary to prevent such a situation from arising. Meanwhile, if the printing is once again started from the position at which the printing was suspended, the suspension will occur for a certain amount of time in order to re-generate the data; this leads to variations in the amount of time that ink droplets are present on the medium, color differences caused by differences in bleeding amounts and slight positional variations in the printing, which in turn leads to a drop in the print quality, and thus it is necessary to prevent such a situation from arising as well. Finally, in the case where the ink in either the first or second ink cartridge 34 or 35 has been exhausted partway through a page, the print data should be re-generated in order to carry out the printing using only the nozzles that communicate with the ink cartridge 34 or 35 in which ink still remains; however, it is nevertheless necessary to suspend the printing partway through the page, and thus it is necessary to prevent this type of situation from arising as well.

Although estimating the remaining ink amount and rejecting the reception of print data for which the estimated amount of consuming ink is thought to be greater than the remaining ink amount can be considered as a way of suppressing the ink from being exhausted and the printing from being suspended partway through a page, the estimation of the remaining ink amount is not accurate due to the occurrence of error, and thus such a technique is not desirable. This is due to the following reasons. When estimating the remaining ink amount, an estimated ink consumption amount is estimated by multiplying the number of ink ejections by the ejection amount for each ejection and then sequentially subtracting that amount from the initial fill amount of the ink cartridge. However, there are variations in the ejection amounts due to differences in the properties of the respective piezoelectric elements 261, differences in the ink mass due to temperature changes, and so on, and thus it is easy for errors to occur when estimating the ink consumption amount. Accordingly, it is not desirable to estimate the remaining ink amount and reject the reception of print data for which the estimated amount of consumed ink is thought to be greater than the remaining ink amount, as described above.

Accordingly, in this embodiment, a near end amount is set in order to continuously ensure a remaining ink amount capable of printing the print data, so that the ink within the ink cartridges is not exhausted partway through a page. Setting a near end amount in this manner makes it possible to ensure a remaining ink amount capable of printing to the end of the print data, which makes it possible to continuously print to the end of the print data.

Figure 4:
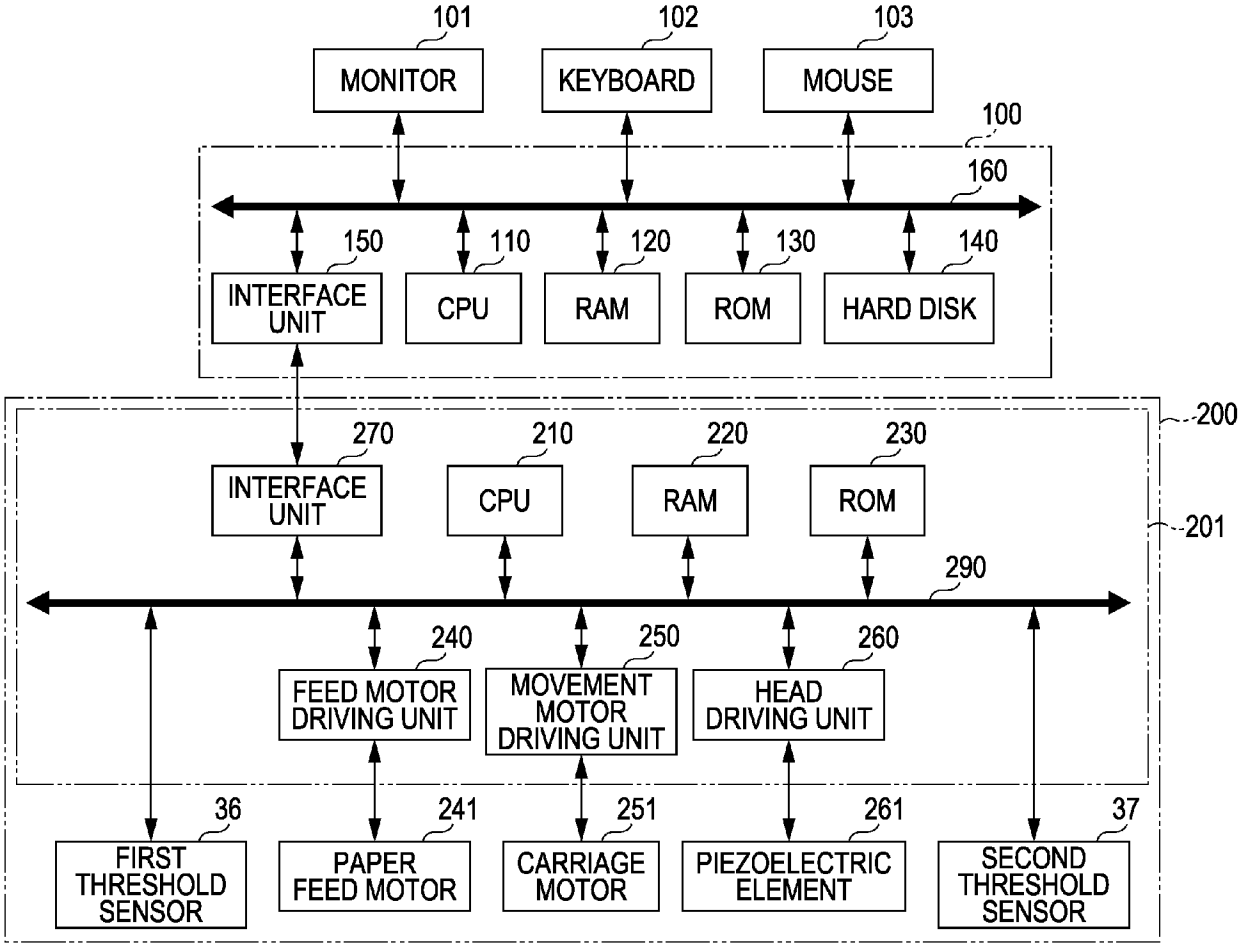
FIG. 4 is a block diagram illustrating the electrical configuration of the printing system according to the first embodiment.

Specifically, the CPU 210 of the control unit 201 shown in FIG. 4 obtains the signals outputted from the first and second threshold sensors 36 and 37 provided in the first and second ink cartridges 34 and 35 as mentioned above. If at least one of the obtained outputted signals is an "on" signal, the CPU 210 can recognize that it will soon be necessary to replace the ink cartridge. In this embodiment, a near end amount is set based on the print data, and thus an amount of ink that makes it possible to print to the end of the print data remains in the first and second ink cartridges 34 and 35 even after the "on" signal has been inputted from the first and second threshold sensors 36 and 37; therefore, it is possible to print to the end of the print data. This makes it possible to prevent the printing from ending partway through a page.

Hereinafter, processing performed by the CPU 210 will be described in detail using FIG. 5.

First, in step S1, print data generated by the CPU 110 based on a print command inputted to the computer 100, or in other words, a liquid ejection command, is inputted into the CPU 210 of the printer 200. The process then advances to step S2.

In step S2, the CPU 210 drives the carriage motor 251 and the paper feed motor 241 based on the inputted print data, and executes one pass of printing in the main scanning direction. The process then advances to step S3.

In step S3, the CPU 210 determines whether or not the printing is complete. In the case where the printing is complete (YES), the process ends. However, in the case where the printing is not complete, the process advances to step S4.

In step S4, the CPU 210 obtains the signal outputted from the first threshold sensor 36 provided in the first ink cartridge 34. The process then advances to step S5.

In step S5, the CPU 210 obtains the signal outputted from the second threshold sensor 37 provided in the second ink cartridge 35. The process then advances to step S6.

In step S6, the CPU 210 determines whether or not at least one of the obtained signals outputted from the first and second threshold sensors 36 and 37 is an "on" signal. In other words, the CPU 210 determines whether or not there is a cartridge whose remaining ink amount is low. If both the first and second threshold sensors 36 and 37 have inputted "off" signals (NO), the process returns to step S2, and the processes from step S2 to step S6 are once again executed. However, if at least one of the first and second threshold sensors 36 and 37 have inputted an "on" signal (YES), the process advances to step S7.

In step S7, the CPU 210 determines whether or not both of the obtained signals outputted from the first and second threshold sensors 36 and 37 are "on" signals. In the case where both of the outputted signals are "on" signals (YES), the process advances to step S8. However, in the case where only one of the outputted signals is an "on" signal (NO), the process advances to step S9.

In step S8, the remaining passes are printed until the print data ends. In other words, in this embodiment, even in the case where it is known from the first and second threshold sensors 36 and 37 that the remaining ink amount is low, the printing is carried out until the end of the inputted print data, preventing the printing from being suspended partway through a page. In this case, the near end amount obtained through the first and second threshold sensors 36 and 37 is, as mentioned above, set to an amount capable of filling an entire page, and therefore it is possible to print to the end of that page, or in other words, possible to print to the end of the print data, even if at least one of the first and second threshold sensors 36 and 37 has reacted partway through the page.

After this, the process advances to step S10, and in step S10, the CPU 210 makes a notification of an instruction to replace the ink, after which the processing ends. This notification is, for example, outputted in a display unit such as the monitor 101.

As in step S8, in step S9, the remaining passes are printed until the print data ends. In other words, in this embodiment, the printing is carried out until the end even in the case where the ink in only one of the ink cartridges has become low, in the same manner as when the ink in both of the ink cartridges has been exhausted, which prevents the printing from being suspended partway through the page. After the remaining passes in the print data have been printed, the process advances to step S11.

In step S11, the CPU 210 selects a mode in which printing is carried out using more ink from the ink cartridge whose threshold sensor is outputting the "off" signal than from the ink cartridge whose threshold sensor is outputting the "on" signal. In other words, the CPU 210 switches from a mode in which printing is carried out using the first and second ink cartridges 34 and 35 equally to a mode in which printing is carried out using the ink cartridge in which more ink remains, after which the process ends. When the CPU 210 selects the mode in this manner, a signal indicating which mode has been selected is inputted from the CPU 210 to the CPU 110 in the computer 100. Thereafter, the next time a printing target is inputted, the CPU 110 of the computer 100 generates the print data in accordance with that mode.

In this manner, in this embodiment, when print data is inputted, the print data can be printed to the end regardless of the state of the ink cartridges, which prevents the printing from being suspended partway through a sheet.

Second Embodiment

Figure 6:
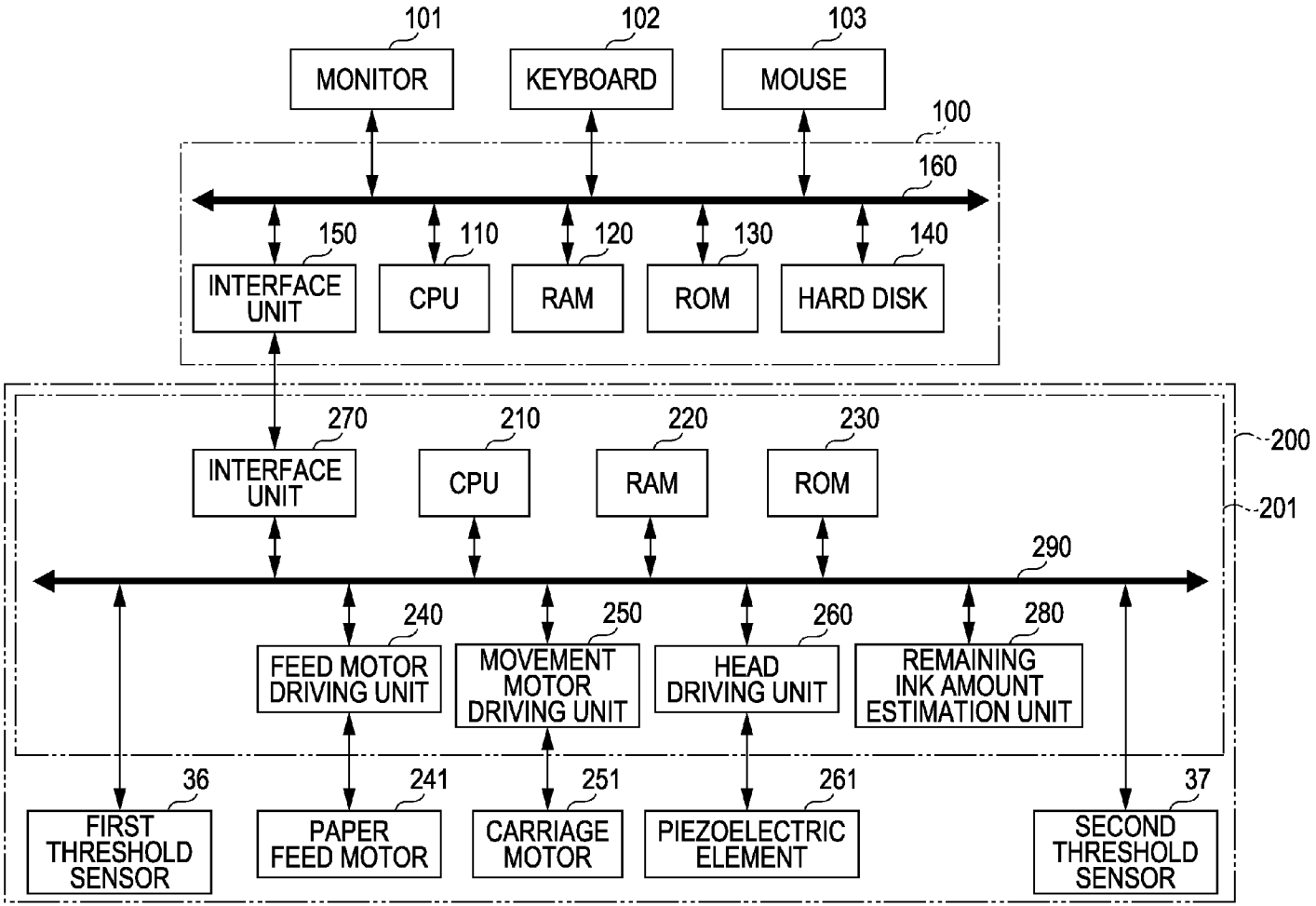
FIG. 6 is a block diagram illustrating the electrical configuration of the printing system according to a second embodiment.

In this embodiment, as shown in FIG. 6, the control unit 201 according to the first embodiment further includes a remaining ink amount estimation unit 280, and the configuration is such that the remaining ink amounts in the first and second ink cartridges 34 and 35 are estimated and the ink in both of these ink cartridges is exhausted at the same time. This will be described in more detail using FIGS. 3 and 6.

The CPU 210 according to this embodiment is connected to the remaining ink amount estimation unit 280 provided in the control unit 201. The remaining ink amount estimation unit 280 estimates the remaining ink amounts of the ink cartridges 31 through 35 and outputs the estimated amounts. Note that when estimating the remaining ink amount, an estimated ink consumption amount is estimated by multiplying the number of ink ejections by the ejection amount for each ejection and then sequentially subtracting that amount from the initial fill amount of the ink cartridge.

By providing the remaining ink amount estimation unit 280, the remaining ink amounts in the ink cartridges 31 through 35 is estimated; accordingly, a usage ratio between the first ink cartridge 34 and the second ink cartridge 35 is set based on the differences in remaining ink amounts between the first ink cartridge 34 and the second ink cartridge 35, which adjusts the times when the first and second ink cartridges 34 and 35 need to be replaced to the same time. This is due to the following reasons.

When the first and second ink cartridges 34 and 35 are replaced, what are known as a cleaning process and a flushing process are executed. In the cleaning process, the carriage 20 shown in FIG. 1 is moved to an area that is distanced from the medium 50, a cap member (not shown) is tightly affixed to the nozzle surface of the recording head, and suction operations are carried out. Meanwhile, in the flushing process, the carriage 20 is moved to an area that is distanced from the medium 50, and ink is ejected. As a result, ink can be evenly dispersed to the first and second flow channels 34*b* and 35*b*. Because the ink consumed in the cleaning process and the flushing process is not applied in printing, it is desirable to replace the ink cartridges 34 and 35 at the same time in order to increase the efficiency at which the ink is used.

Accordingly, in the case where the remaining ink amount in the first and second ink cartridges 34 and 35 is essentially the same, it is necessary to cause the inks to decrease at the same rate. On the other hand, in the case where there is an imbalance in the remaining ink amounts, it is necessary to increase the consumption of the ink in the ink cartridge with the higher remaining ink amount beyond the consumption of the ink in the ink cartridge with the lower remaining ink amount.

Accordingly, in this embodiment, when at least one of the first and second threshold sensors 36 and 37 has outputted an "on" signal, it is assumed that it is nearing the time at which a cartridge needs to be replaced, and thus under the control of the CPU 210, the head driving unit 260 changes the usage frequencies of the first ejection portion 44, the second ejection portion 45, and the first and second individual ejection portions 46*a* and 46*b* in accordance with the remaining amounts in the first and second ink cartridges 34 and 35.

In other words, in this embodiment, in the case where the difference in the remaining amounts between the first and second ink cartridges 34 and 35 is high, the mode is switched from a normal mode, in which the same amounts are used from the first and second ink cartridges 34 and 35, to a mode in which only the ink cartridge with the higher remaining ink amount is used, whereas in the case where the difference in the remaining amounts is low, the mode is switched to a mode in which the amount used by the ink cartridge that has a higher remaining ink amount is higher than the amount used by the ink cartridge that has the lower remaining ink amount; in this manner, the times when the first and second ink cartridges 34 and 35 need to be replaced are adjusted to the same time.

For example, in the case where an "on" signal has been outputted to the CPU 210 from the first threshold sensor 36 provided in the first ink cartridge 34, the remaining ink amount estimation unit 280 estimates the remaining ink amounts in the first and second ink cartridges 34 and 35 and outputs the estimated amounts to the CPU 210. Then, in the case where the difference between the remaining ink amounts is greater than a threshold Vth, the CPU 210 carries out printing so that ink is not ejected through the first ejection portion 44 and the first individual ejection portion 46*a* connected to the first ink cartridge 34 but ink is ejected through the second ejection portion 45 and the second individual ejection portion 46*b* connected to the second ink cartridge 35. Note that the "threshold Vth" referred to here is determined by the maximum value for the difference in the remaining amounts at which it is possible to correct the difference in the remaining ink amounts between the first and second ink cartridges 34 and 35, from when the near end amount has been reached to the ink end, at which it is actually impossible to print anymore.

Meanwhile, in the case where the difference between the remaining ink amounts is less than the threshold Vth, of the first and second ink cartridges 34 and 35, the ejection amount from the ink cartridge that has a higher remaining ink amount is increased beyond the ejection amount from the ink cartridge that has the lower remaining ink amount. For example, in the case where an "on" signal has been outputted to the CPU 210 from the first threshold sensor 36 provided in the first ink cartridge 34, assuming that the ink ejection amount from the first ejection portion 44 and the first individual ejection portion 46*a* connected to the first ink cartridge 34 is 1, printing is carried out so that a greater amount of ink than 1 is ejected through the second ejection portion 45 and the second individual ejection portion 46*b* connected to the second ink cartridge 35.

Figure 7:
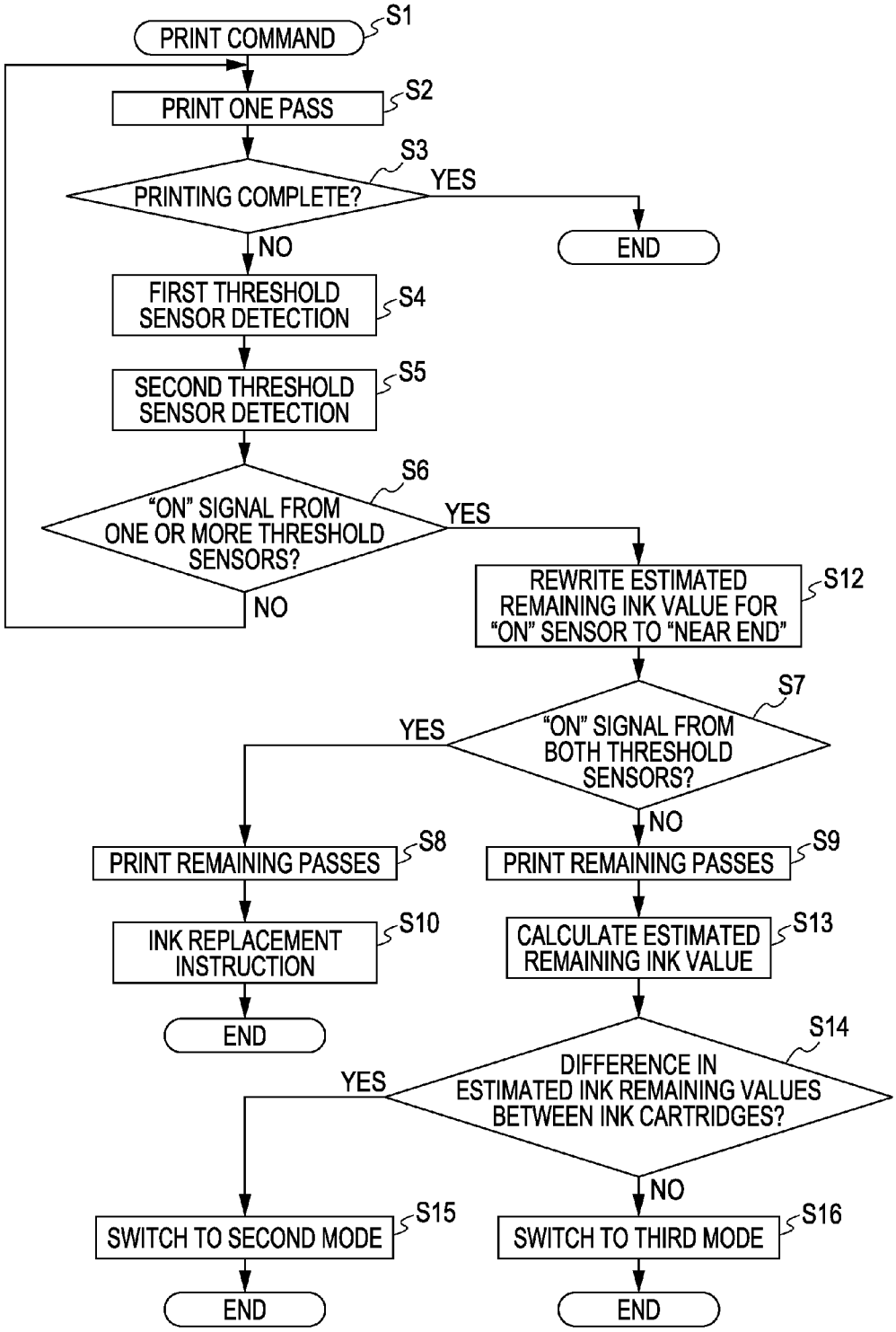
FIG. 7 is a flowchart illustrating processing performed by a control unit according to the second embodiment.

To describe this using an example, there are three modes of usage frequencies, or a first (normal) mode M1, a second mode M2, and a third mode M3, as shown in FIG. 7. Assuming that the usage frequencies of the three ejection portions, or the first ejection portion 44, the second ejection portion 45, and the first and second individual ejection portions 46*a* and 46*b*, are Ra, Rb, Rc, and Rd respectively, in the normal mode M1, Ra:Rb:Rc:Rd=1:1:0.5:0.5, and thus the amount of ink consumed is the same for the first ink cartridge 34 and the second ink cartridge 35.

In the case of the second mode M2, where the difference between the remaining ink amounts is greater than the threshold Vth, Ra:Rb:Rc:Rd=0:1:0:0, and thus the configuration is such that only the ink of the second ink cartridge 35 is consumed. In this case, the ink ejection amount is low and the ink ejection nozzles are few, and thus the CPU 210 controls the feed motor driving unit 240 that drives the paper feed motor 241 so as to reduce the speed of printing in order to make it possible to print in the desired manner. Note that in the second mode M2, the ratio can also be set to Ra:Rb:Rc:Rd=0:1:0:1.

Furthermore, in the case of the third mode M3, where the difference between the remaining ink amounts is less than the threshold Vth, Ra:Rb:Rc:Rd=1:1:0:1. In this case, a greater amount of ink is consumed from the second ink cartridge 35 than from the first ink cartridge 34, which makes it possible to make the ratio of consumption between the ink cartridges approximately the same.

Of course, the ratio between the usage frequencies Ra, Rb, Rc, and Rd may be set as appropriate in accordance with, for example, the remaining ink amounts.

Accordingly, in this embodiment, adjusting the amounts of ink consumed from the first and second ink cartridges 34 and 35 makes it possible for the user to replace all the ink cartridges at the same time, which in turn makes it possible to reduce the number of replacements and eliminate effort on the part of the user.

In addition, reducing the number of replacements also reduces the number of times the cleaning and flushing operations are carried out after the ink cartridge that is to be replaced has actually been replaced; this makes it possible to reduce the total amount of ink that is consumed due to cleaning and flushing the ink cartridges, which in turn makes it possible to reduce the amount of ink that is consumed.

Note that if the first and second threshold sensors 36 and 37 are not provided, and the remaining ink amount is estimated based only on the remaining ink amount estimation carried out by the remaining ink amount estimation unit 280, it is thought that the degree of error will increase, and thus it is desirable to provide the first and second threshold sensors 36 and 37, as in this embodiment.

Control carried out in the case where the remaining ink amount estimation unit 280 is further provided will be described in detail using FIG. 7. Note that steps in FIG. 7 that are the same as those in FIG. 5 are assumed to be identical steps.

Figure 5:
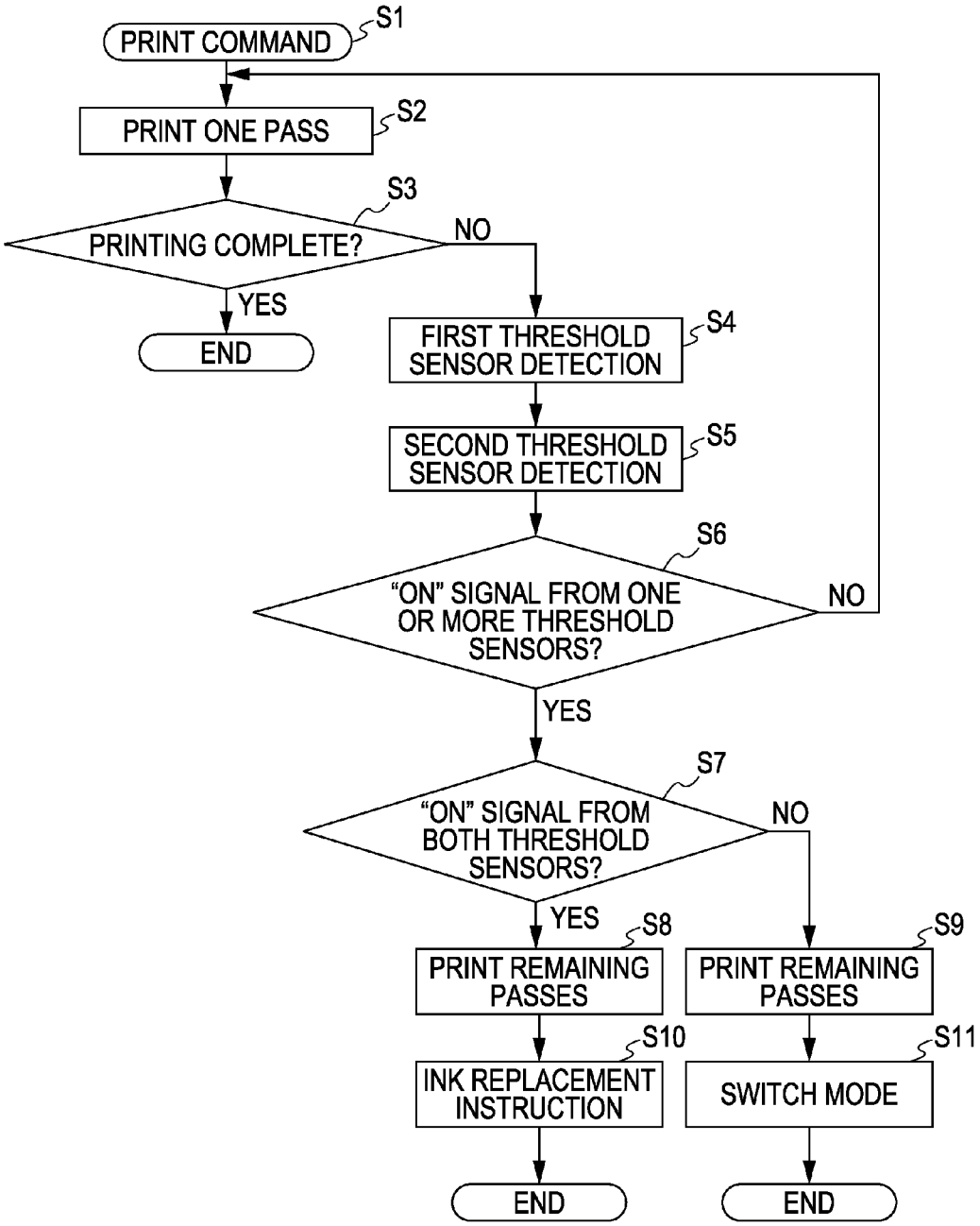
FIG. 5 is a flowchart illustrating processing performed by a control unit according to the first embodiment.

Steps S1 through S6 are the same as those shown in FIG. 5, and thus descriptions thereof will be omitted. If at least one of the first and second threshold sensors 36 and 37 have inputted an "on" signal in step S6, the process advances to step S12.

In step S12, the remaining ink amount estimation unit 280 overwrites the estimated value for the remaining ink amount with a near end value for any ink cartridge provided with a threshold sensor from which an "on" signal has been inputted. In other words, there are cases in which a small amount of error arises in the estimation of the remaining ink amount due to variations in the performance of the piezoelectric element and so on, and therefore in the case where an "on" signal from a threshold sensor has been inputted, error in the remaining ink amount estimation is reduced by overwriting the estimated remaining ink amount with the near end amount. The process then advances to step S7.

Step S7 is the same as that described in the first embodiment; in this step, the CPU 210 determines whether or not both of the obtained signals outputted from the first and second threshold sensors 36 and 37 are "on" signals. In the case where both of the outputted signals are "on" signals (YES), the process advances to step S8. However, in the case where only one of the outputted signals is an "on" signal (NO), the process advances to step S9.

Step S8 and step S10 are the same as those described in the first embodiment, and therefore descriptions thereof will be omitted.

Step S9 is also the same as that described in the first embodiment; in this step, the remaining passes are printed until the print data ends. In other words, in this embodiment, the printing is carried out until the end of the page even in the case where the ink in only one of the ink cartridges has become low, in the same manner as when the ink in both of the first and second ink cartridges 34 and 35 has been exhausted, which prevents the printing from being suspended partway through the page. The process then advances to step S13.

In step S13, the remaining ink amount estimation unit 280 estimates the remaining ink amounts for the first and second ink cartridges 34 and 35 respectively. Note that in step S12, in the case where the remaining ink amount estimated values for either of the first and second ink cartridges 34 and 35 have been overwritten with the near end amount, the remaining ink amount estimation unit 280 uses the near end amount as the remaining ink amount estimated value. The process then advances to step S14.

In step S14, it is determined whether or not the difference between the estimated remaining ink amounts for the first and second ink cartridges 34 and 35 is greater than the threshold Vth. In the case where the difference is greater (YES), the process advances to step S15. In the case where the difference is less (NO), the process advances to step S16.

In step S15, the mode is switched to the aforementioned second mode, and the process ends. When the CPU 210 selects the second mode in this manner, a signal indicating that the second mode has been selected is inputted from the CPU 210 to the CPU 110 in the computer 100. When the next printing command is inputted thereafter, the computer 100 generates the print data based on the second mode, so that Ra:Rb:Rc:Rd=0:1:0:0.

In step S16, the mode is switched to the aforementioned third mode, and the process ends. When the CPU 210 selects the third mode in this manner, a signal indicating that the third mode has been selected is inputted from the CPU 210 to the CPU 110 in the computer 100. When the next printing command is inputted thereafter, the computer 100 generates the print data based on the third mode, so that Ra:Rb:Rc:Rd=1:1:0:1.

In this manner, in this embodiment, when print data is inputted, the print data can be printed to the end regardless of the state of the ink cartridges, and thus the printing can be prevented from being suspended partway through a sheet. Furthermore, thereafter, the mode can be switched from the first mode to the second or the third mode in accordance with the remaining amount of ink, which results in the ink cartridges being replaced at the same time.

The invention is not intended to be limited to the aforementioned first and second embodiments, and the following variations, for example, are also possible.

Although the first and second ink cartridges 34 and 35 are replaced at the same time in the aforementioned embodiments, the first and second ink cartridges 34 and 35 may be replaced as soon as an "on" signal has been outputted from the first or second threshold sensor 36 or 37.

Although the aforementioned embodiments describe an example in which there is one ink cartridge each for the colors cyan, magenta, and yellow and two ink cartridges for the color black, the numbers of ink cartridges for the respective colors are not limited to these numbers. For example, a plurality of ink cartridges may be provided for the colors cyan, magenta, and yellow. Even in such a case, it is possible to provide each ink cartridge with a threshold sensor, and reduce printing suspensions occurring partway through a page.

Although the aforementioned embodiments describe an example in which liquid surface sensors provided in the first and second ink cartridges 34 and 35 are used as the first and second threshold sensors 36 and 37, the sensors are not limited thereto as long as the sensors are capable of detecting the remaining ink amounts. For example, the configuration may be such that light-transmissive ink cartridges are used as the first and second ink cartridges 34 and 35, light-receiving elements are disposed to the rear of the ink cartridges, light is irradiated from a light source provided within the liquid ejecting apparatus, and the light-receiving elements can receive that light in the case where the amount of ink has decreased. In other words, the first and second threshold sensors 36 and 37 may be provided in the ink cartridges, or may be provided in the printer 200.

Although the first and second ink cartridges 34 and 35 are provided in the printer 200 in the aforementioned embodiments, the invention is not limited thereto. For example, the configuration may be such that the ink cartridges are disposed outside of the printer 200, and the ink cartridges and liquid ejecting head are connected using tubes or the like.

Although the aforementioned embodiments describe the printer 200 that ejects ink as an example of the liquid ejecting apparatus, the invention is not limited thereto, and various types of liquid ejecting apparatuses that eject a liquid as liquid droplets may be employed. The liquid ejecting apparatus may be, for example, a printing apparatus such as a fax machine, a copier, or the like; a liquid ejecting apparatus that ejects a liquid such as an electrode material, a color material, or the like used in the manufacture of liquid crystal displays, EL displays, and front emission displays; a liquid ejecting apparatus that ejects a bioorganic matter used in the manufacture of biochips; a sample material ejecting apparatus serving as a precision pipette; and so on. The invention may also be applied in a valve apparatus used in an apparatus aside from a liquid ejecting apparatus.

What is claimed is:

1. A control apparatus for a liquid ejecting head, the liquid ejecting head including nozzle rows in which nozzles that eject a liquid from two or more liquid holding units that hold the same liquid are arranged in rows and an ejection unit that causes the liquid to be ejected through the nozzles, and the control apparatus for the liquid ejecting head causing the liquid to be ejected through the nozzles by driving the liquid ejecting head based on a liquid ejection command when the liquid ejection command has been inputted, the control apparatus comprising:

an input section that obtains a threshold passed signal outputted from a threshold sensor that detects the actual remaining liquid amount in the liquid holding unit, the threshold passed signal indicates that a threshold for a remaining liquid amount has been passed, wherein when the threshold passed signal is inputted from the threshold sensor to the input section while the liquid ejection command is being executed, the control apparatus drives the liquid ejecting head so that the liquid continues to be ejected based on the liquid ejection command until the inputted liquid ejection command ends;

a remaining liquid amount estimation unit that estimates a remaining liquid amount that is the remaining amount of liquid held in each of the liquid holding units, wherein in the case where the threshold passed signal has been inputted from at least one of the two or more liquid holding units after the ejection unit has been driven until the inputted liquid ejection command ends, the control apparatus determines whether or not the difference between the remaining liquid amounts estimated by the remaining liquid amount estimation unit from the remaining liquid amount estimation unit is greater than a predetermined value;

in the case where the difference between the remaining liquid amounts estimated by the remaining liquid amount estimation unit from the remaining liquid amount estimation unit is greater than the predetermined value, when the next liquid ejection command is executed, the control apparatus carries out control so that the liquid is ejected only through the nozzle rows to which the liquid is supplied from the liquid holding unit that has the greater remaining amount of liquid; and in the case where the difference between the remaining liquid amounts estimated by the remaining liquid amount estimation unit from the remaining liquid amount estimation unit is less than the predetermined value, when the next liquid ejection command is executed, the control apparatus carries out control so that the liquid ejection amount of the nozzle rows to which the liquid is supplied from the liquid holding unit having a higher remaining amount is greater than the liquid ejection amount of the nozzle rows to which the liquid is supplied from the liquid holding unit having a lower remaining amount.

2. The control apparatus for a liquid ejecting head according to claim 1, wherein in the case where the threshold passed signal has been inputted from all of the two or more liquid holding units after the ejection unit has been driven until the inputted liquid ejection command ends, the control apparatus makes a notification prompting all of the two or more liquid holding units to be replaced; and in the case where the threshold passed signal has been inputted from one of the two or more liquid holding units, when the next liquid ejection command is executed, the control apparatus drives the ejection unit so that the ejection amount of the nozzle row to which the liquid is supplied from the liquid holding unit whose threshold sensor outputted the threshold passed signal becomes less than the ejection amounts of the other nozzle rows.

3. The control apparatus for a liquid ejecting head according to claim 1, wherein the control apparatus carries out a notification prompting the liquid holding unit, of the two or more liquid holding units, that is provided with the threshold sensor from which the threshold passed signal has been inputted to be replaced after the ejection unit has been driven until the inputted liquid ejection command ends.

4. The control apparatus for a liquid ejecting head according to claim 1, wherein the nozzle rows are configured of first and second nozzle rows whose respective nozzles are in the same position in a nozzle row direction and third and fourth nozzle rows whose nozzle positions are skewed from each other in the nozzle row direction; and the first nozzle row and the third nozzle row are connected to a first liquid holding unit, and the second nozzle row and the fourth nozzle row are connected to a second liquid holding unit.

5. A liquid ejecting apparatus comprising:

a liquid ejecting head including nozzle rows in which nozzles that eject a liquid from two or more liquid holding units that hold the same liquid are arranged in rows and an ejection unit that causes the liquid to be ejected through the nozzles;

a control unit that causes the liquid to be ejected through the nozzles by driving the liquid ejecting head based on a liquid ejection command when the liquid ejection command has been inputted;

threshold sensors that detect the actual remaining liquid amount in respective liquid holding units and input threshold passed signals indicating that the remaining liquid amounts have exceeded a threshold to the control unit, wherein when the threshold passed signal is inputted from the threshold sensor during the execution of the liquid ejection command, the control unit drives the liquid ejecting head so as to continue ejecting the liquid based on the inputted liquid ejection command until the liquid ejection command ends; and a remaining liquid amount estimation unit that estimates a remaining liquid amount that is the remaining amount of liquid held in each of the liquid holding units, wherein in the case where the threshold passed signal has been inputted from at least one of the two or more liquid holding units after the ejection unit has been driven until the inputted liquid ejection command ends, the control apparatus determines whether or not the difference between the remaining liquid amounts estimated by the remaining liquid amount estimation unit from the remaining liquid amount estimation unit is greater than a predetermined value;

in the case where the difference between the remaining liquid amounts estimated by the remaining liquid amount estimation unit from the remaining liquid amount estimation unit is greater than the predetermined value, when the next liquid ejection command is executed, the control apparatus carries out control so that the liquid is ejected only through the nozzle rows to which the liquid is supplied from the liquid holding unit that has the greater remaining amount of liquid; and in the case where the difference between the remaining liquid amounts estimated by the remaining liquid amount estimation unit from the remaining liquid amount estimation unit is less than the predetermined value, when the next liquid ejection command is executed, the control apparatus carries out control so that the liquid ejection amount of the nozzle rows to which the liquid is supplied from the liquid holding unit having a higher remaining amount is greater than the liquid ejection amount of the nozzle rows to which the liquid is supplied from the liquid holding unit having a lower remaining amount.

6. The liquid ejecting apparatus of claim 5, wherein the nozzle rows are configured of first and second nozzle rows whose respective nozzles are in the same position in a nozzle row direction and third and fourth nozzle rows whose nozzle positions are skewed from each other in the nozzle row direction; and the first nozzle row and the third nozzle row are connected to a first liquid holding unit, and the second nozzle row and the fourth nozzle row are connected to a second liquid holding unit.

7. A liquid ejecting apparatus comprising:

a liquid ejecting head including nozzle rows in which nozzles that eject a liquid from two or more liquid holding units that hold the same liquid are arranged in rows and an ejection unit that causes the liquid to be ejected through the nozzles;

a control unit that causes the liquid to be ejected through the nozzles by driving the liquid ejecting head based on a liquid ejection command when the liquid ejection command has been inputted, a threshold sensor that detects the actual remaining liquid amount in the liquid holding unit, wherein when a threshold passed signal indicating that a threshold for a remaining liquid amount has been passed is inputted from the threshold sensor when the liquid ejection command is being executed, the control apparatus drives the liquid ejecting head so that the liquid continues to be ejected based on the liquid ejection command until the inputted liquid ejection command ends; and a remaining liquid amount estimation unit that estimates a remaining liquid amount that is the remaining amount of liquid held in each of the liquid holding units, wherein in the case where the threshold passed signal has been inputted from at least one of the two or more liquid holding units after the ejection unit has been driven until the inputted liquid ejection command ends, the control apparatus determines whether or not the difference between the remaining liquid amounts estimated by the remaining liquid amount estimation unit from the remaining liquid amount estimation unit is greater than a predetermined value;

in the case where the difference between the remaining liquid amounts estimated by the remaining liquid amount estimation unit from the remaining liquid amount estimation unit is greater than the predetermined value, when the next liquid ejection command is executed, the control apparatus carries out control so that the liquid is ejected only through the nozzle rows to which the liquid is supplied from the liquid holding unit that has the greater remaining amount of liquid; and in the case where the difference between the remaining liquid amounts estimated by the remaining liquid amount estimation unit from the remaining liquid amount estimation unit is less than the predetermined value, when the next liquid ejection command is executed, the control apparatus carries out control so that the liquid ejection amount of the nozzle rows to which the liquid is supplied from the liquid holding unit having a higher remaining amount is greater than the liquid ejection amount of the nozzle rows to which the liquid is supplied from the liquid holding unit having a lower remaining amount.

8. The liquid ejecting apparatus of claim 7, wherein the nozzle rows are configured of first and second nozzle rows whose respective nozzles are in the same position in a nozzle row direction and third and fourth nozzle rows whose nozzle positions are skewed from each other in the nozzle row direction; and the first nozzle row and the third nozzle row are connected to a first liquid holding unit, and the second nozzle row and the fourth nozzle row are connected to a second liquid holding unit.

9. A control method for a liquid ejecting head including nozzle rows in which nozzles that eject a liquid from two or more liquid holding units that hold the same liquid are arranged in rows and an ejection unit that causes the liquid to be ejected through the nozzles, the control method causing the liquid to be ejected through the nozzles by driving the liquid ejecting head based on a liquid ejection command when the liquid ejection command has been inputted, wherein when a threshold sensor that inputs a threshold passed signal in the case where the threshold sensor has detected that the remaining amount of liquid held in a corresponding liquid holding unit has exceeded a threshold has inputted the threshold passed signal during the execution of the liquid ejection command, the liquid ejecting head is driven so that the liquid continues to be ejected based on the liquid ejection command until the inputted liquid ejection command ends; and estimating, by a remaining liquid amount estimation unit, a remaining liquid amount that is the remaining amount of liquid held in each of the liquid holding units, wherein in the case where the threshold passed signal has been inputted from at least one of the two or more liquid holding units after the ejection unit has been driven until the inputted liquid ejection command ends, the control apparatus determines whether or not the difference between the remaining liquid amounts estimated by the remaining liquid amount estimation unit from the remaining liquid amount estimation unit is greater than a predetermined value;

in the case where the difference between the remaining liquid amounts estimated by the remaining liquid amount estimation unit from the remaining liquid amount estimation unit is greater than the predetermined value, when the next liquid ejection command is executed, the control apparatus carries out control so that the liquid is ejected only through the nozzle rows to which the liquid is supplied from the liquid holding unit that has the greater remaining amount of liquid; and in the case where the difference between the remaining liquid amounts estimated by the remaining liquid amount estimation unit from the remaining liquid amount estimation unit is less than the predetermined value, when the next liquid ejection command is executed, the control apparatus carries out control so that the liquid ejection amount of the nozzle rows to which the liquid is supplied from the liquid holding unit having a higher remaining amount is greater than the liquid ejection amount of the nozzle rows to which the liquid is supplied from the liquid holding unit having a lower remaining amount.

10. The control method of claim 9, wherein the nozzle rows are configured of first and second nozzle rows whose respective nozzles are in the same position in a nozzle row direction and third and fourth nozzle rows whose nozzle positions are skewed from each other in the nozzle row direction; and the first nozzle row and the third nozzle row are connected to a first liquid holding unit, and the second nozzle row and the fourth nozzle row are connected to a second liquid holding unit.

* * * * *